US012043808B2

(12) United States Patent
Schwab

(10) Patent No.: US 12,043,808 B2
(45) Date of Patent: Jul. 23, 2024

(54) QUATERNARY AMMONIUM SALT COMBINATIONS FOR INJECTOR CLEANLINESS

(71) Applicant: Afton Chemical Corporation, Richmond, VA (US)

(72) Inventor: Scott D. Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 63 days.

(21) Appl. No.: 17/679,464

(22) Filed: Feb. 24, 2022

(65) Prior Publication Data

US 2023/0203394 A1 Jun. 29, 2023

Related U.S. Application Data

(63) Continuation-in-part of application No. 17/563,904, filed on Dec. 28, 2021, now abandoned.

(51) Int. Cl.
*C10L 10/04* (2006.01)
*C10L 1/222* (2006.01)

(52) U.S. Cl.
CPC ..... *C10L 10/04* (2013.01); *C10L 1/2222* (2013.01); *C10L 2200/029* (2013.01); *C10L 2270/026* (2013.01)

(58) Field of Classification Search
CPC .. C10L 10/04; C10L 1/2222; C10L 2200/029; C10L 2270/026
See application file for complete search history.

(56) References Cited

U.S. PATENT DOCUMENTS

| | | | |
|---|---|---|---|
| 2,129,264 | A | 9/1938 | Baxter et al. |
| 2,568,876 | A | 9/1951 | White et al. |
| 2,886,423 | A | 5/1959 | Kozikowski |
| 3,015,668 | A | 1/1962 | Kozikowski |
| 3,027,246 | A | 3/1962 | Bartlett |
| 3,092,474 | A | 6/1963 | Ebner |
| 3,198,613 | A | 8/1965 | Udelhofen |
| 3,468,640 | A | 9/1969 | Barusch et al. |
| 3,778,371 | A | 12/1973 | Malec |
| 4,056,531 | A | 11/1977 | Malec |
| 4,067,698 | A | 1/1978 | Steckel |
| 4,152,499 | A | 5/1979 | Boerzel et al. |
| 4,171,959 | A | 10/1979 | Vartanian |
| 4,234,435 | A | 11/1980 | Meinhardt et al. |
| 4,248,719 | A | 2/1981 | Chafetz et al. |
| 4,253,980 | A | 3/1981 | Hammond et al. |
| 4,326,973 | A | 4/1982 | Hammond et al. |
| 4,338,206 | A | 7/1982 | Hammond et al. |
| 4,482,357 | A | 11/1984 | Hanlon |
| 4,787,916 | A | 11/1988 | Feldman |
| 5,024,677 | A | 6/1991 | Wang et al. |
| 5,250,174 | A | 10/1993 | Hart |
| 5,254,138 | A | 10/1993 | Kurek |
| 5,330,667 | A | 7/1994 | Tiffany, III et al. |
| 5,575,823 | A | 11/1996 | Wallace et al. |
| 5,752,989 | A | 5/1998 | Henly et al. |
| 5,756,428 | A | 5/1998 | Emert et al. |
| 6,405,711 | B1 | 6/2002 | Smith et al. |
| 6,462,014 | B1 | 10/2002 | Johnson et al. |
| 7,297,675 | B2 | 11/2007 | Allef et al. |
| 7,402,185 | B2 | 7/2008 | Aradi et al. |
| 7,744,660 | B2 | 6/2010 | Burrington et al. |
| 7,906,470 | B2 | 3/2011 | Stevenson et al. |
| 7,947,093 | B2 | 5/2011 | Barton et al. |
| 7,951,211 | B2 | 5/2011 | Barton et al. |
| 8,153,570 | B2 | 4/2012 | Barton et al. |
| 8,259,643 | B2 | 9/2012 | Nam et al. |
| 8,475,541 | B2 | 7/2013 | Fang et al. |
| 8,765,650 | B2 | 7/2014 | Delbridge et al. |
| 8,863,700 | B2 | 10/2014 | Fang et al. |
| 8,894,726 | B2 * | 11/2014 | Fang ..... C10L 1/2383 44/331 |
| 8,961,623 | B2 | 2/2015 | Stevenson et al. |
| 8,974,551 | B1 | 3/2015 | Fang et al. |
| 9,062,265 | B2 | 6/2015 | Reid et al. |
| 9,340,742 | B1 | 5/2016 | Fang et al. |
| 9,951,285 | B2 | 4/2018 | Roeger-Goepfert et al. |
| 10,308,888 | B1 * | 6/2019 | Schwab ..... C10L 1/224 |
| 2003/0000149 | A1 | 1/2003 | Aradi et al. |
| 2003/0001315 | A1 | 7/2003 | Colucci et al. |
| 2004/0000297 | A1 | 2/2004 | Frick et al. |
| 2004/0001670 | A1 | 8/2004 | Dahlmann et al. |

(Continued)

FOREIGN PATENT DOCUMENTS

| | | | |
|---|---|---|---|
| CN | 101671584 | A | 3/2010 |
| EP | 0293192 | A1 | 11/1988 |

(Continued)

OTHER PUBLICATIONS

Shanahan, Charles S. et al., "A General Method for Fouling Injectors in Gasoline Direct Injection Vehicles and the Effects of Deposits on Vehicle Performance", SAE Int. J. Fuels Lubr., vol. 10, No. 3, (Nov. 2017), 11 pages, doi : 10 .4271/2017-01-2298.

Smith, S. Scott, et al., "Measurement and Control of Fuel Injector Deposits in Direct Injection Gasoline Vehicles", SAE International; Oct. 14, 2013, (10 pages), doi: 10.4271/2013-01-2616.

*Primary Examiner* — James C Goloboy

(74) *Attorney, Agent, or Firm* — Honigman LLP

(57) ABSTRACT

The present disclosure provides fuel additives including quaternary ammonium salt mixtures, fuel compositions including such additives, and methods of improving performance of fuel injector using such additives.

7 Claims, 1 Drawing Sheet

(56) References Cited

U.S. PATENT DOCUMENTS

| | | | |
|---|---|---|---|
| 2005/0001206 | A1 | 6/2005 | Koch et al. |
| 2006/0002725 | A1 | 12/2006 | Burrington et al. |
| 2007/0000156 | A1 | 1/2007 | Allef et al. |
| 2007/0001931 | A1 | 1/2007 | Ma |
| 2008/0001138 | A1 | 5/2008 | Moreton et al. |
| 2008/0003076 | A1 | 12/2008 | Barton et al. |
| 2009/0002827 | A1 | 11/2009 | Malfer et al. |
| 2010/0000242 | A1 | 2/2010 | Smith et al. |
| 2010/0000375 | A1 | 2/2010 | Petrucci et al. |
| 2010/0001513 | A1 | 6/2010 | Papachristos et al. |
| 2010/0002365 | A1 | 9/2010 | Shea et al. |
| 2011/0002589 | A1 | 1/2011 | Ho |
| 2011/0001856 | A1 | 8/2011 | Barton et al. |
| 2011/0002374 | A1 | 9/2011 | Khandekar et al. |
| 2011/0003028 | A1 | 12/2011 | Fang et al. |
| 2011/0003085 | A1 | 12/2011 | Reid |
| 2011/0003151 | A1 | 12/2011 | Grabarse et al. |
| 2012/0000101 | A1 | 1/2012 | Grabarse et al. |
| 2012/0001380 | A1 | 6/2012 | Stevenson et al. |
| 2012/0002913 | A1 | 11/2012 | Martin et al. |
| 2013/0002989 | A1 | 1/2013 | Noguchi et al. |
| 2013/0000318 | A1 | 2/2013 | Reid et al. |
| 2013/0001048 | A1 | 5/2013 | Burgess et al. |
| 2013/0002202 | A1 | 8/2013 | Fang |
| 2013/0002332 | A1 | 9/2013 | Barbour |
| 2013/0002962 | A1 | 11/2013 | Hansch et al. |
| 2013/0003336 | A1 | 12/2013 | Fang et al. |
| 2014/0001576 | A1 | 6/2014 | Reid |
| 2014/0001743 | A1 | 6/2014 | Reid et al. |
| 2015/0000336 | A1 | 2/2015 | Arondel et al. |
| 2015/0002522 | A1 | 9/2015 | Bush et al. |
| 2016/0001529 | A1 | 6/2016 | Reid et al. |
| 2017/0000966 | A1 | 4/2017 | Bush et al. |
| 2017/0001015 | A1 | 4/2017 | Stevenson et al. |
| 2017/0001074 | A1 | 4/2017 | Greenfield et al. |
| 2017/0001142 | A1 | 4/2017 | Arters et al. |
| 2017/0001216 | A1 | 5/2017 | Moreton et al. |
| 2017/0001668 | A1 | 6/2017 | Culley et al. |
| 2017/0002182 | A1 | 8/2017 | Reid et al. |
| 2018/0000662 | A1 | 3/2018 | Gahagan et al. |
| 2018/0002232 | A1 | 8/2018 | Cook |

FOREIGN PATENT DOCUMENTS

| | | | |
|---|---|---|---|
| EP | 1518918 | A1 | 3/2005 |
| EP | 2033945 | A1 | 3/2009 |
| EP | 2674471 | A1 | 12/2013 |
| EP | 2987845 | A1 | 2/2016 |
| EP | 2531580 | B1 | 11/2017 |
| GB | 842728 | A | 7/1960 |
| WO | 2010132209 | A1 | 11/2010 |
| WO | 201300503 | A1 | 1/2013 |
| WO | 2013000738 | A2 | 1/2013 |
| WO | 2013017889 | A1 | 2/2013 |
| WO | 2013092533 | A1 | 6/2013 |
| WO | 2015011505 | A1 | 1/2015 |
| WO | 2017168312 | A1 | 10/2017 |

* cited by examiner

QUATERNARY AMMONIUM SALT COMBINATIONS FOR INJECTOR CLEANLINESS

CROSS-REFERENCE TO RELATED APPLICATIONS

This application is a continuation-in-part of U.S. application Ser. No. 17/563,904 filed Dec. 28, 2021, which is hereby incorporated by reference in its entirety.

TECHNICAL FIELD

This disclosure is directed to fuel additives including combinations of quaternary ammonium salts, fuels including such additive combinations, and to methods for using such salt combinations in a fuel composition as fuel detergents.

BACKGROUND

Fuel compositions for vehicles are continually being improved to enhance various properties of the fuels in order to accommodate their use in newer, more advanced engines. Often, improvements in fuel compositions center around improved fuel additives and other components used in the fuel. For example, friction modifiers may be added to fuel to reduce friction and wear in the fuel delivery systems of an engine. Other additives may be included to reduce the corrosion potential of the fuel or to improve the conductivity properties. Still other additives may be blended with the fuel to improve fuel economy. Engine and fuel delivery system deposits represent another concern with modern combustion engines, and therefore other fuel additives often include various deposit control additives to control and/or mitigate engine deposit problems. Thus, fuel compositions typically include a complex mixture of additives.

However, there remain challenges when attempting to balance such a complex assortment of additives. For example, some of the conventional fuel additives may be beneficial for one characteristic, but at the same time be detrimental to another characteristic of the fuel. Other fuel additives often require an unreasonably high treat rate to achieve their desired effect, which tends to place undesirable limits on the available amounts of other additives in the fuel composition. Yet other additives tend to be expensive and/or difficult to manufacture and use in fuels. Such shortcomings are particularly true in the context of quaternary ammonium salt fuel additives that are often difficult or costly to manufacture and/or require relatively high treat rates for performance.

SUMMARY

In one aspect, a method of providing improved engine performance is provided herein. In one embodiment or approach, the method includes providing a fuel composition to an engine and combusting the fuel composition in the engine; the fuel composition including a major amount of fuel and a minor amount of a deposit control mixture. The deposit control mixture including a first quaternary ammonium salt additive and second quaternary ammonium salt additive, the deposit control mixture including no more than 50 weight percent of the first quaternary ammonium salt additive. The first quaternary ammonium salt additive includes a hydrocarbyl substituent having a number average molecular weight of about 150 to about 500. The second quaternary ammonium salt additive has the structure of Formula III $[(R_{10})(R_{11})N—(CH_2)_n—X_m—(CH_2)_n—X_m—(CH_2)_n—N^+(R_7)(R_8)(R_9)]^-$ (Formula III) wherein each X is a bivalent moiety selected from the group consisting of —O—, —N($R_{12}$)—, —C(O)—, —C(O)O—, or —C(O)N$R_{12}$; each $R_7$, $R_8$, and $R_9$ are independently alkyl groups containing 1 to 8 carbon atoms; $R_{10}$ and $R_{11}$ are independently selected from an alkyl group, acyl group, or a hydrocarbyl substituted acyl group, the hydrocarbyl substituent of one or both of $R_{10}$ and $R_{11}$ having a number average molecular weight of about 700 or greater; $R_{12}$ is independently a hydrogen or a group selected from $C_{1-6}$ aliphatic, phenyl, or alkylphenyl; each m is independently an integer of 0 or 1 with at least one m being 1; each n is independently an integer of 1 to 10; and M is a carboxylate.

In other embodiments, the method of providing improved engine performance of the preceding paragraph may be combined with one or more optional features, steps, or embodiments in any combination. These optional features, steps, or embodiments may include one or more of the following: wherein the first quaternary ammonium salt additive has the structure of Formula II: $R_4$—C(O)—N($R_6$)—R—$N^+$($R_5$)($R_5$)—R'—C(O)$O^-$ (Formula II) wherein R and R' are independently alkylene linkers having 1 to 10 carbon atoms; $R_4$ is a hydrocarbyl group or optionally substituted hydrocarbyl group having a number average molecular weight of about 150 to about 500, or an aryl group or optionally substituted aryl group; each $R_5$ is independently a linear or branched C1 to C4 alkyl group; and $R_6$ is hydrogen or a C1 to C4 alkyl group; and/or wherein $R_{10}$ and $R_{11}$ together with the nitrogen atom to which they are attached combine to form a ring moiety; and/or wherein the deposit control mixture includes a ratio of the first quaternary ammonium salt additive to the second quaternary ammonium salt additive of about 1:1 to about 1:10 (or at least about 1:3, at least about 1:4, at least about 1:5, at least about 1:6, at least about 1:7, at least about 1:8, at least about 1:9, at least about 1:10, about 1:3 to about 1:10, about 1:4 to about 1:10, or about 1:5 to about 1:10, or about 1:8 to about 1:10); and/or wherein the fuel composition includes about 0.1 to about 50 ppmw of the first quaternary ammonium salt additive and about 1 to about 100 ppmw of the second quaternary ammonium salt additive; and/or wherein the fuel composition includes no more than about 100 ppmw of the deposit control mixture including both the first and second quaternary ammonium salt additives; and/or wherein R and R' of Formula II are independently alkylene linkers having 1 to 3 carbon atoms and $R_4$ of Formula II is a C8 to C20 hydrocarbyl group; and/or wherein R' of Formula II is a methylene linker; and/or wherein each $R_5$ of Formula II is a methyl group; and/or wherein the carboxylate of Formula III is oxalate, salicylate, or combinations thereof; and/or wherein X of Formula III is —O— or —NH—; and/or wherein the second quaternary ammonium salt additive of Formula III is derived from 3-(2-(dimethylamino) ethoxy) propylamine, N,N-dimethyldipropylene triamine, or mixtures thereof; and/or wherein $R_{10}$ and $R_{11}$ of Formula III, together with the nitrogen atom to which they are attached, combine to form a hydrocarbyl substituted succinimide; and/or wherein the hydrocarbyl substituent has a number average molecular weight of about 700 to about 2,500; and/or wherein $R_4$ is a C8 to C20 hydrocarbyl group, each of R and R' are independently alkylene linkers having 1 to 3 carbon atoms, each $R_5$ is a methyl group, and $R_6$ is hydrogen; and/or wherein X is an oxygen atom and wherein $R_{10}$ and $R_{11}$ of Formula III, together with the nitrogen atom to which they are attached, combine to form a hydrocarbyl substituted succinimide with the hydrocarbyl substituent having a number average molecular weight of about 700 to about 1,500 as measured by GPC using polystyrene as a calibration reference.

In another approach or embodiments, the present disclosure provides a fuel composition including a deposit control additive mixture for providing improved engine performance. In aspects, the fuel composition includes a major amount of fuel and a minor amount of a deposit control additive mixture including at least a first quaternary ammonium salt additive and a second quaternary ammonium salt additive, wherein the deposit control additive mixture includes no more than 50 weight percent of the first quaternary ammonium salt additive. The first quaternary ammonium salt additive includes a hydrocarbyl substituent having a number average molecular weight of about 150 to about 500. The second quaternary ammonium salt additive has the structure of Formula III $[(R_{10})(R_{11})N—(CH_2)_n—X_m—(CH_2)_n—X_m—(CH_2)_n—N^+(R_7)(R_8)(R_9)]^-$ (Formula III) wherein each X is a bivalent moiety selected from the group consisting of —O—, $—N(R_{12})—$, —C(O)—, —C(O)O—, or $—C(O)NR_{12}$; each $R_7$, $R_8$, and $R_9$ are independently alkyl groups containing 1 to 8 carbon atoms; $R_{10}$ and Rui are independently selected from an alkyl group, an acyl group, or a hydrocarbyl substituted acyl group the hydrocarbyl substituent of one or both of $R_{10}$ and $R_{11}$ having a number average molecular weight of about 700 or greater; $R_{12}$ is independently a hydrogen or a group selected from $C_{1-6}$ aliphatic, phenyl, or alkylphenyl; each m is independently an integer of 0 or 1 with at least one m being 1; each n is independently an integer of 1 to 10; and M is a carboxylate.

In other embodiments, the fuel composition of the previous paragraph includes optional features and embodiments in any combination. These optional features and embodiments include one or more of the following: wherein the first quaternary ammonium salt additive has the structure of Formula II $R_4—C(O)—N(R_6)—R—N^+(R_5)(R_5)—R'—C(O)O^-$ (Formula II) wherein R and R' are independently alkylene linkers having 1 to 10 carbon atoms; $R_4$ is a hydrocarbyl group or optionally substituted hydrocarbyl group having a molecular weight of about 150 to about 500, or an aryl group or optionally substituted aryl group; each $R_5$ is independently a linear or branched C1 to C4 alkyl group; $R_6$ is hydrogen or a C1 to C4 alkyl group; and/or wherein the deposit control additive mixture provides a weight ratio of the first quaternary ammonium salt additive to the second quaternary ammonium salt additive of about 1:1 to about 1:10 (or at least about 1:3, at least about 1:4, at least about 1:5, at least about 1:6, at least about 1:7, at least about 1:8, at least about 1:9, at least about 1:10, about 1:3 to about 1:10, about 1:4 to about 1:10, or about 1:5 to about 1:10, or about 1:8 to about 1:10); and/or wherein the deposit control additive mixture includes about 10 to about 40 weight percent of the first quaternary ammonium salt additive; and/or wherein the fuel composition includes about 0.1 to about 50 ppmw of the first quaternary ammonium salt additive and about 1 to about 100 ppmw of the second quaternary ammonium salt additive; and/or wherein the fuel composition includes no more than about 100 ppmw of the deposit control additive mixture including both the first and tetramethylethylenediamine, second quaternary ammonium salt additives; and/or wherein $R_4$ is a C8 to C20 hydrocarbyl group, each of R and R' are independently alkylene linkers having 1 to 3 carbon atoms, each $R_5$ is a methyl group, and $R_6$ is hydrogen; and/or wherein X of Formula III is an oxygen atom and wherein $R_{10}$ and $R_{11}$ of Formula III, together with the nitrogen atom to which they are attached, combine to form a hydrocarbyl substituted succinimide where the hydrocarbyl substituent has a number average molecular weight of about 700 to about 1,500 as measured by GPC using polystyrene as a calibration reference; and/or wherein $R_{10}$ and $R_{11}$ of Formula III, together with the nitrogen atom to which they are attached, combine to form a ring moiety.

In yet other embodiments, the present disclosure provides for the use of a deposit control additive mixture for providing improved engine performance wherein the use includes combusting a major amount of fuel and a minor amount of a deposit control additive mixture including at least a first quaternary ammonium salt additive and a second quaternary ammonium salt additive, wherein the deposit control additive mixture includes no more than 50 weight percent of the first quaternary ammonium salt additive to achieve improved engine performance such as reduced intake valve deposits and/or clean-up as measured according to CEC F98-08 DW10. The first quaternary ammonium salt additive includes a hydrocarbyl substituent having a number average molecular weight of about 150 to about 500. The second quaternary ammonium salt additive has the structure of Formula III $$R_4—C(O)—N(R_6)—R—N^+(R_5)(R_5)—R'—C(O)O^- \quad \text{(Formula III)}$$

wherein each X is a bivalent moiety selected from the group consisting of —O—, $—N(R_{12})—$, —C(O)—, —C(O)O—, or $—C(O)NR_{12}$; each $R_7$, $R_8$, and $R_9$ are independently alkyl groups containing 1 to 8 carbon atoms; $R_{10}$ and $R_{11}$ are independently selected from an alkyl group, an acyl group, or a hydrocarbyl substituted acyl group, the hydrocarbyl substituent of one or both of $R_{10}$ and $R_{11}$ having a number average molecular weight of about 700 or greater; $R_{12}$ is independently a hydrogen or a group selected from $C_{1-6}$ aliphatic, phenyl, or alkylphenyl; each m is independently an integer of 0 or 1 with at least one m being 1; each n is independently an integer of 1 to 10; and M is a carboxylate. The use may also include any other embodiments as set forth in this Summary.

DRAWING FIGURES

DETAILED DESCRIPTION

Figure 1:
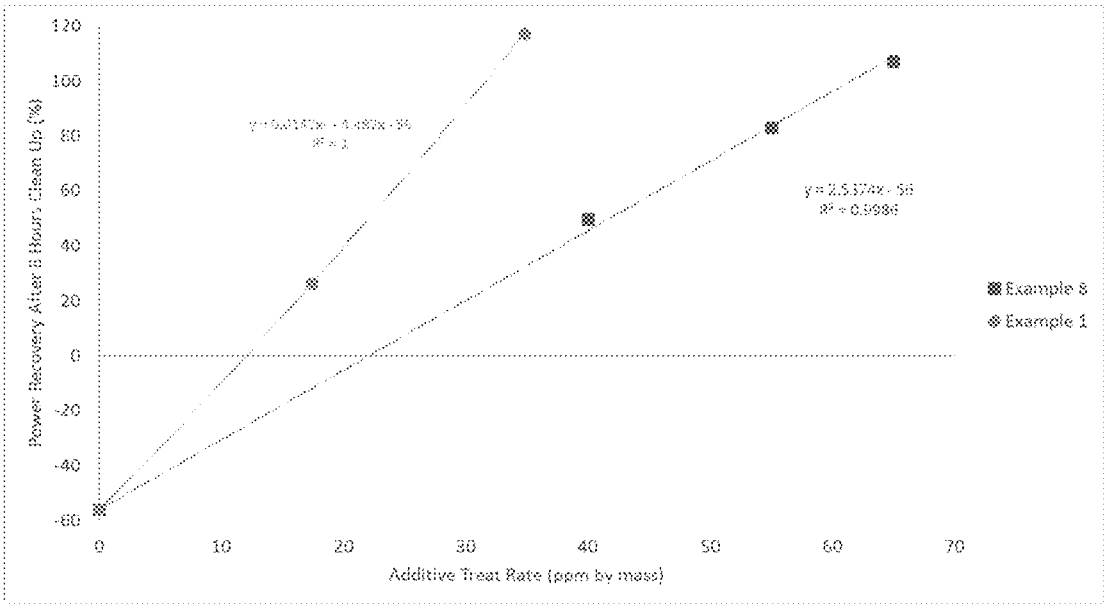
FIG. 1 is a plot of power recovery relative to additive treat rate.

The present disclosure provides fuel additives including combinations of quaternary ammonium salts, and in particular, combinations of low molecular weight and high molecular weight hydrocarbyl-substituted quaternary ammonium salts formed by reacting an alkylating or quaternizing agent with a wide variety of hydrocarbyl-substituted tertiary amine compounds. Also provided herein are fuel compositions including the novel fuel additive combinations and methods of using or combusting a fuel including the fuel additive combinations herein. The unique quaternary ammonium salt combinations herein are beneficial because they can be made through a simple alkylation process, surprisingly achieve a high degree of quaternization, and provide improved detergency at low treat rates, in some instances, through a unique combination of low molecular weight substitution and high molecular weight substitution on the quaternary ammonium salts, and in yet other instances, a unique combination of cationic quaternary ammonium salts and betaine quaternary ammonium salts or compounds.

In one aspect of this disclosure, an exemplary fuel additive includes a mixture of a first quaternary ammonium salt additive and a second quaternary ammonium salt additive. In embodiments, the first quaternary ammonium salt additive of the mixture has a low molecular weight hydrocarbyl substituent, such as a number average molecular weight hydrocarbyl substituent of 500 or less, and in other instances, about 150 to about 500. In other embodiments, the second quaternary ammonium salt additive of the mixtures herein has a high molecular weight hydrocarbyl substituent, such as a number average molecular weight hydrocarbyl substituent of about 700 or greater, and in other instances, about 700 to about 5,000, and in yet other instances, about 900 to about 2,500. As discussed more below, the first quaternary ammonium salt additive with the low molecular weight hydrocarbyl substituent may provide, in some embodiments, zwitterionic nitrogen in a so-called internal salt (or betaine compound) and the second quaternary ammonium salt additive with the high molecular weight hydrocarbyl substituent, in some embodiments, provides cationic nitrogen and is a more conventional cationic salt.

The quaternary ammonium salt additives suitable for either the first or the second additives herein may be made by reacting a wide variety of amine, polyamine, or derivatives thereof having a tertiary amino group with a suitable quaternizing agent. For example, either the first and/or the second quaternary ammonium salt additives herein may be (i) a reaction product of a hydrocarbyl-substituted acylating agent and a compound having at least one oxygen or nitrogen atom capable of condensing with said acylating agent and further having a tertiary amino group and reacted with (ii) a quaternizing agent. In one approach, the amine with a tertiary amino group may be a wide variety of amine and polyamines having a tertiary amino group and capable of being quaternized so long as the resultant quaternary ammonium salts have the hydrocarbyl substituents and other characteristics as further described herein.

In one approach, the general amine or poly amine suitable for either the first or second quaternary ammonium salt herein may be a tertiary amine of the general formula (Formula I)

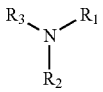

wherein each of $R_1$, $R_2$, and $R_3$ is selected from hydrocarbyl groups containing from 1 to 200 carbon atoms may be used. Each hydrocarbyl group $R_1$ to $R_3$ may independently be linear, branched, substituted, cyclic, saturated, unsaturated, or contain one or more hetero atoms. Suitable hydrocarbyl groups may include, but are not limited to alkyl groups, aryl groups, alkylaryl groups, arylalkyl groups, alkoxy groups, aryloxy groups, amido groups, ester groups, imido groups, and the like. Any of the foregoing hydrocarbyl groups may also contain hetero atoms, such as oxygen or nitrogen atoms. Particularly suitable hydrocarbyl groups may be linear or branched alkyl groups. Some representative examples of amine reactants which can be reacted to yield compounds of this invention are: trimethyl amine, triethyl amine, tri-n-propyl amine, dimethylethyl amine, dimethyl lauryl amine, dimethyl oleyl amine, dimethyl stearyl amine, dimethyl eicosyl amine, dimethyl octadecyl amine, N-methyl piperidine, N,N'-dimethyl piperazine, N-methyl-N-ethyl piperazine, N-methyl morpholine, N-ethyl morpholine, N-hydroxyethyl morpholine, pyridine, triethanol amine, triisopropanol amine, methyl diethanol amine, dimethyl ethanol amine, lauryl diisopropanol amine, stearyl diethanol amine, dioleyl ethanol amine, dimethyl isobutanol amine, methyl diisooctanol amine, dimethyl propenyl amine, dimethyl butenyl amine, dimethyl octenyl amine, ethyl didodecenyl amine, dibutyl eicosenyl amine, triethylene diamine, hexamethylene tetramine, N,N,N',N'-tetramethylethylenediamine, N,N,N',N'-tetramethylpropylenediamine, N,N,N',N'-tetraethyl-1,3-propanediamine, methyldi-cyclohexyl amine, 2,6-dimethylpyridine, dimethylcylohexylamine, $C_{10}$-$C_{30}$-alkyl or alkenyl-substituted amidopropyldimethylamine, $C_{12}$-$C_{200}$-alkyl or alkenyl-substituted succinic-carbonyldimethylamine, succinimide deriviatives thereof, and the like.

In other approaches, if the amine contains solely primary or secondary amino groups, it is necessary to alkylate at least one of the primary or secondary amino groups to a tertiary amino group prior to the reaction with the suitable quaternizing agent. In one embodiment, alkylation of primary amines and secondary amines or mixtures with tertiary amines may be exhaustively or partially alkylated to a tertiary amine. It may be necessary to properly account for the hydrogen on the nitrogen and provide base or acid as required (e.g., alkylation up to the tertiary amine requires removal (neutralization) of the hydrogen (proton) from the product of the alkylation). If alkylating agents, such as, alkyl halides or dialkyl sulfates are used, the product of alkylation of a primary or secondary amine is a protonated salt and needs a source of base to free the amine for further reaction.

Quaternizing agents for the additives herein, in general, may also be a wide variety of compounds suitable for alkylating a tertiary amine. As discussed further below, suitable examples of quaternizing agents include, but are not limited to, dialkyl sulphates, esters of a carboxylic acids, alkyl halides, benzyl halides, hydrocarbyl substituted carbonates, hydrocarbyl epoxides in combination with an acid, or mixtures thereof. Other examples may include halides, hydroxides, sulphonates, bisulphites, alkyl sulphates, sulphones, phosphates, alkylphosphates, borates, alkylborates, nitrites, nitrates, carbonates, bicarbonates, alkanoates, alkyldithiophosphates, and the like quaternizing agent, and/or mixtures thereof.

As used herein, the term "hydrocarbyl group" or "hydrocarbyl" or "hydrocarbyl substituent" is used in its ordinary sense, which is well-known to those skilled in the art. Specifically, it refers to a group having a carbon atom directly attached to the remainder of a molecule and having a predominantly hydrocarbon character. Examples of hydrocarbyl groups include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); (3) hetero-substituents, that is, substituents which, while having a predominantly hydrocarbon character, in the context of this description, contain other than carbon in a ring or chain otherwise composed of carbon atoms. Heteroatoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 weight percent, for example about 80 weight percent to about 98 weight percent relative to the total weight of the composition. Moreover, as used herein, the term "minor amount" is understood to mean an amount less than 50 weight percent relative to the total weight of the composition.

As used herein, the term "percent by weight", unless expressly stated otherwise, means the percentage the recited component represents to the weight of the entire composition. As also used herein, the term "ppm," unless otherwise indicated, is the same as "ppmw," which means parts per million by weight.

Unless stated otherwise, the term "alkyl" as employed herein refers to straight, branched, cyclic, and/or substituted saturated chain moieties of from about 1 to about 100 carbon atoms. The term "alkenyl" as employed herein refers to straight, branched, cyclic, and/or substituted unsaturated chain moieties of from about 3 to about 10 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

The number average molecular weight for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500 to 380,000 g/mol. The calibration curve can be extrapolated for samples having a mass less than 500 g/mol. Samples and PS standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

First Quaternary Ammonium Salt Additive: In one aspect, the first quaternary ammonium salt additive of the mixtures herein may be any quaternary ammonium salt having a low molecular weight hydrocarbyl substituent, such as a hydrocarbyl substituent having a number average molecular weight of about 500 or less, and in other approaches, about 150 to about 500, or about 200 to about 500. In other aspects, the first quaternary ammonium salt additive may be an internal salt (or betaine) having the low molecular weight hydrocarbyl substituent and obtained from amines or polyamines that are substantially devoid of any free anion species. For example, such additive may be made by reacting a tertiary amine of Formula I

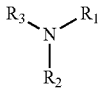

(Formula I)

wherein each of $R_1$, $R_2$, and $R_3$ is selected from hydrocarbyl groups containing from 1 to 200 carbon atoms, with a halogen substituted C2-C8 carboxylic acid, ester, amide, or salt thereof. In these preferred approaches, what is generally to be avoided in the reaction of this first additive is quaternizing agents selected from the group consisting of hydrocarbyl substituted carboxylates, carbonates, cyclic-carbonates, phenates, epoxides, or mixtures thereof. In one embodiment, the halogen substituted C2-C8 carboxylic acid, ester, amide, or salt thereof may be selected from chloro-, bromo-, fluoro-, and iodo-C2-C8 carboxylic acids, esters, amides, and salts thereof. The salts may be alkali or alkaline earth metal salts selected from sodium, potassium, lithium calcium, and magnesium salts. A particularly useful halogen substituted compound for use in the reaction is the sodium or potassium salt of a chloroacetic acid.

As used herein the term "substantially devoid of free anion species" means that the anions, for the most part are covalently bound to the product such that the reaction product as made does not contain substantial amounts of free anions or anions that are ionically bound to the product. In one embodiment, "substantially devoid" means a range from 0 to less than about 2 weight percent of free anion species, less than about 1.5 weight percent less than about 1 weight percent, less than about 0.5 weight percent, or none.

In another approach or embodiment, a tertiary amine including monoamines and polyamines may be reacted with the halogen substituted acetic acid, ester, or other derivative thereof to provide the first quaternary ammonium salt additive herein. Suitable tertiary amine compounds are those of Formula I above wherein each of $R_1$, $R_2$, and $R_3$ is selected, as noted above, from hydrocarbyl groups containing from 1 to 200 carbon atoms. Each hydrocarbyl group $R_1$ to $R_3$ may independently be linear, branched, substituted, cyclic, saturated, unsaturated, or contain one or more hetero atoms. Suitable hydrocarbyl groups may include, but are not limited to alkyl groups, aryl groups, alkylaryl groups, arylalkyl groups, alkoxy groups, aryloxy groups, amido groups, ester groups, imido groups, and the like. Any of the foregoing hydrocarbyl groups may also contain hetero atoms, such as oxygen or nitrogen atoms. Particularly suitable hydrocarbyl groups may be linear or branched alkyl groups. In some approaches, the tertiary amine may be the reaction product of a diamine or triamine with one tertiary amine and a hydrocarbyl substituted carboxylic acid. In other approaches, some representative examples of amine reactants which can be reacted to yield compounds of this disclosure include, but are not limited to, trimethyl amine, triethyl amine, tri-n-propyl amine, dimethylethyl amine, dimethyl lauryl amine, dimethyl oleyl amine, dimethyl stearyl amine, dimethyl eicosyl amine, dimethyl octadecyl amine, N,N-dimethylpropane diamine, N-methyl piperidine, N,N'-dimethyl piperazine, N-methyl-N-ethyl piperazine, N-methyl morpholine, N-ethyl morpholine, N-hydroxyethyl morpholine, pyridine, triethanol amine, triisopropanol amine, methyl diethanol amine, dimethyl ethanol amine, lauryl diisopropanol amine, stearyl diethanol amine, dioleyl ethanol amine, dimethyl isobutanol amine, methyl diisooctanol amine, dimethyl propenyl amine, dimethyl butenyl amine, dimethyl octenyl amine, ethyl didodecenyl amine, dibutyl eicosenyl amine, triethylene diamine, hexa-methylenetetramine, N,N,N',N'-tetramethylethylenediamine, N,N,N',N'-tetramethyl-propylenediamine, N,N,N',N'-tetraethyl-1,3-propanediamine, methyldi-cyclohexyl amine, 2,6-dimethylpyridine, dimethylcylohexylamine, C10-C30-alkyl or alkenyl-substituted amidopropyldimethylamine, C12-C200-alkyl or alkenyl-substituted succinic-carbonyl-dimethylamine, and the like. A suitable first quaternary ammonium salt additive may be the internal salts of oleyl amidopropyl dimethylamino or oleyl dimethyl amine.

If the amine contains solely primary or secondary amino groups, it may be necessary to alkylate at least one of the primary or secondary amino groups to a tertiary amino group prior to the reaction with the halogen substituted C2-C8 carboxylic acid, ester, amide, or salt thereof. In one embodiment, alkylation of primary amines and secondary amines or mixtures with tertiary amines may be exhaustively or partially alkylated to a tertiary amine. It may also be necessary to properly account for the hydrogens on the nitrogen and provide base or acid as required (e.g., alkylation up to the tertiary amine requires removal (neutralization) of the hydrogen (proton) from the product of the alkylation). If alkylating agents, such as, alkyl halides or dialkyl sulfates are used, the product of alkylation of a primary or secondary amine is a protonated salt and needs a source of base to free the amine for further reaction.

The halogen substituted C2-C8 carboxylic acid, ester, amide, or salt thereof for use in making the first quaternary salt additive may be derived from a mono-, di-, or tri-chloro-, bromo-, fluoro-, or iodo-carboxylic acid, ester, amide, or salt thereof selected from the group consisting of halogen-substituted acetic acid, propanoic acid, butanoic acid, isopropanoic acid, isobutanoic acid, tert-butanoic acid, pentanoic acid, heptanoic acid, octanoic acid, halo-methyl benzoic acid, and isomers, esters, amides, and salts thereof. The salts of the carboxylic acids may include the alkali or alkaline earth metal salts, or ammonium salts including, but not limited to the Na, Li, K, Ca, Mg, triethyl ammonium and triethanol ammonium salts of the halogen-substituted carboxylic acids. A particularly suitable halogen substituted carboxylic acid, ester, or salt thereof may be selected from chloroacetic acid or esters thereof and sodium or potassium chloroacetate. The amount of halogen substituted C2-C8 carboxylic acid, ester, amide, or salt thereof relative to the amount of tertiary amine reactant may range from a molar ratio of about 1:0.1 to about 0.1:1.0.

In yet other approaches, such internal salts of the first quaternary ammonium salt additive of the mixtures herein may be made according to the foregoing procedures may include, but are not limited to (1) hydrocarbyl substituted compounds of the formula R"—$NMe_2CH_2COO$ where R" is from C1 to C30 or a substituted amido group; (2) fatty amide substituted internal salts; and (3) hydrocarbyl substituted imide, amide, or ester internal salts wherein the hydrocarbyl group has 8 to 40 carbon atoms. Particularly suitable internal salts may be selected from the group consisting of polyisobutenyl substituted succinimide, succinic diamide, and succinic diester internal salts; C8-C40 alkenyl substituted succinimide, succinic diamide, and succinic diester internal salts; oleyl amidopropyl dimethylamino internal salts; and oleyl dimethylamino internal salts.

In yet another approach, the first quaternary ammonium salt of the mixtures herein is an internal salt or betaine compound having the structure of Formula II $$R_4—C(O)—N(R_6)—R—N^{+}(R_5)(R_5)—R'—C(O)O^{-} \quad \text{(Formula II)}$$

wherein R and R' are independently alkylene linkers having 1 to 10 carbon atoms (in other approaches 1 to 3 carbon atoms); $R_4$ is independently a hydrocarbyl group or optionally substituted hydrocarbyl group having a number average molecular weight of about 150 to about 500, or an aryl group or optionally substituted aryl group (in one approach, $R_4$ is a C8 to C20 hydrocarbyl group); each $R_5$ is independently a linear or branched C1 to C4 alkyl group; and $R_6$ is a hydrogen atom or a C1 to C4 alkyl group. The internal salts of Formula II may also be substantially devoid of free anion species as discussed above.

In another approach, the first quaternary ammonium salt additive includes the compound of Formula II above wherein R is a propylene linker, R' is a methylene linker, $R_4$ is a C8 to C20 hydrocarbyl group, each $R_5$ is a methyl group, and $R_6$ is hydrogen. In yet other approaches, the first quaternary ammonium salt additive is selected from oleyl amidopropyl dimethylamine internal salts or oleyl dimethylamino internal salts. In some approaches, such additive may be substantially devoid of free anion species.

An exemplary reaction scheme of preparing the first quaternary salt additive is shown below in the exemplary multi-step process of Reaction Scheme I; of course, other methods of preparing the first quaternary ammonium salt additives described herein may also be utilized:

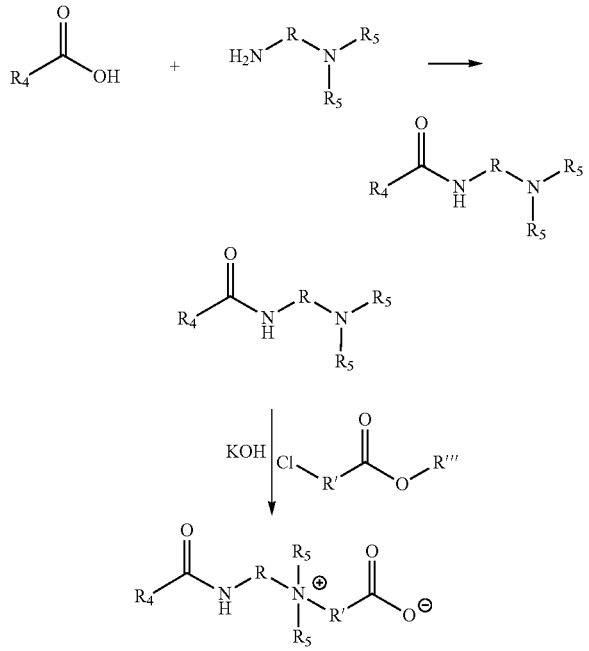

In the reaction scheme above, $R_4$ is an alkyl group such as a hydrocarbyl group having a molecular weight of about 150 to about 500; R and R' are independently alkylene linkers having 1 to 10 carbon atoms; each $R_5$ is independently a alkyl group or a linear or branched $C_1$ to $C_4$ group; and R"' is an alkyl group or hydrogen.

In approaches, the mixture of the first and second quaternary ammonium salts includes no more than 50 weight percent of the first quaternary ammonium salt, and in other embodiments, about 1 to about 50 weight percent, and in yet other approaches, 5 to about 30 weight percent of the first quaternary ammonium salt additive. In yet other approaches, the fuel composition includes about 0.1 to about 50 ppmw, in other approaches, about 0.5 to about 25 ppmw, and in yet other approaches, about 1 to about 10 ppmw of the first quaternary ammonium salt additive. Other ranges within such endpoints are also within the scope of this disclosure.

Second Quaternary Ammonium Salt Additive: In another approach, the second additive of the mixtures herein is any quaternary ammonium salt additive having the high molecular weight hydrocarbyl substituent. In approaches, the second quaternary ammonium salt of the mixtures herein includes a quaternary ammonium salt formed through a reaction between an alkyl carboxylate and an amide or imide compound obtained by reacting a hydrocarbyl substituted acylating agent, such as a high molecular weight hydrocarbyl substituted acylating agent, and an amine.

In one approach, the second quaternary ammonium salt is a cationic salt having the structure of Formula III $$R_4—C(O)—N(R_6)—R—N^{\hat{+}}(R_5)(R_5)—R'—C(O)O^{\hat{-}} \quad \text{(Formula III)}$$

wherein each X is a bivalent moiety selected from the group consisting of —O—, —N($R_{12}$)—, —C(O)—, —C(O)O—, or —C(O)N$R_{12}$; each $R_7$, $R_8$, and $R_9$ are independently alkyl groups containing 1 to 8 carbon atoms; $R_{10}$ and Ru are independently selected from an alkyl group, an acyl group, or a hydrocarbyl substituted acyl group and, optionally, $R_{10}$ and Ru together with the N atom to which they are attached, combine to form a ring moiety (such as a succinimide), the hydrocarbyl substituent of one or both of $R_{10}$ and $R_{11}$ having a number average molecular weight of about 700 or greater (as described herein); $R_{12}$ is independently a hydrogen or a group selected from $C_{1-6}$ aliphatic, phenyl, or alkylphenyl; each m is independently an integer of 0 or 1 with at least one m being 1; each n is independently an integer of 1 to 10; and MΘ is a carboxylate.

In one approach of this aspect, the amine used to form the second quaternary ammonium salt additive may have the structure of Formula IV $$H_2H—(CH_2)_n—X_m—(CH_2)_n—X_m—(CH_2)_n—N(R_7)(R_8) \quad \text{(Formula IV)}$$

with X, $R_7$, $R_8$ and integers n and m as defined above. In a preferred approach, the X moiety is an oxygen atom or nitrogen atom, and more preferably, an oxygen atom. In a preferred approach, the amine is 3-(2-(dimethyl amino) ethoxy)propylamine; N,N-dimethyldipropylenetriamine, or mixtures thereof.

Any of the foregoing described tertiary amines may be reacted with a hydrocarbyl substituted acylating agent having the noted high molecular weight hydrocarbyl substituent described herein to form the second quaternary ammonium salt additive. In approaches, the hydrocarbyl substituted acylating agent may be selected from a hydrocarbyl substituted mono-di- or polycarboxylic acid or a reactive equivalent thereof to form an amide or imide compound. A particularly suitable acylating agent is a hydrocarbyl substituted succinic acid, ester, anhydride, mono-acid/monoester, or diacid. In some approaches, the hydrocarbyl substituted acylating agent is a hydrocarbyl substituted dicarboxylic acid or anhydride derivative thereof, a fatty acid, or mixtures thereof. The hydrocarbyl substituent may have a molecular weight of 700 or more as discussed above.

In other approaches, the hydrocarbyl substituted acylating agent may be carboxylic acid or anhydride reactant. In one approach, the hydrocarbyl substituted acylating agent may be selected from stearic acid, oleic acid, linoleic acid, linolenic acid, palmitic acid, palmitoleic acid, lauric acid, myristic acid, myristoleic acid, capric acid, caprylic acid, arachidic acid, behenic acid, erucic acid, anhydride derivatives thereof, or a combination thereof.

In one approach, the hydrocarbyl substituted acylating agent suitable for the second quaternary ammonium salt additive is a hydrocarbyl substituted dicarboxylic anhydride of Formula V (Formula V)

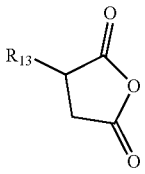

wherein $R_{13}$ of Formula V is a hydrocarbyl or alkenyl group having a high molecular weight as discussed above. In some aspects, $R_{13}$ is a hydrocarbyl group having a number average molecular weight from about 700 to about 5,000, about 700 to about 2,500, or about 700 to about 1,500. In other approaches, the number average molecular weight of $R_{13}$ may range from about 700 to about 1300, as measured by GPC using polystyrene as a calibration reference. A particularly useful $R_{13}$ has a number average molecular weight of about 1000 Daltons and comprises polyisobutylene.

In some approaches, the $R_{13}$ of Formula V is a hydrocarbyl moiety that may comprise one or more polymer units chosen from linear or branched alkenyl units. In some aspects, the alkenyl units may have from about 2 to about 10 carbon atoms. For example, the polyalkenyl radical may comprise one or more linear or branched polymer units formed from ethylene radicals, propylene radicals, butylene radicals, pentene radicals, hexene radicals, octene radicals and decene radicals. In some aspects, the $R_{13}$ polyalkenyl radical may be in the form of, for example, a homopolymer, copolymer or terpolymer. In other aspects, the polyalkenyl radical is polyisobutylene. For example, the polyalkenyl radical may be a homopolymer of polyisobutylene comprising from about 5 to about 60 isobutylene groups, such as from about 15 to about 30 isobutylene groups. The polyalkenyl compounds used to form the Ria polyalkenyl radicals may be formed by any suitable methods, such as by conventional catalytic oligomerization of alkenes.

In some aspects, high reactivity polyisobutylenes having relatively high proportions of polymer molecules with a terminal vinylidene group may be used to form the Ria group. In one example, at least about 60%, such as about 70% to about 90%, of the polyisobutenes comprise terminal olefinic double bonds. In some aspects, approximately one mole of maleic anhydride may be reacted per mole of polyalkylene, such that the resulting polyalkenyl succinic anhydride has about 0.8 to about 1.5 succinic anhydride group per polyalkylene substituent. In other aspects, the molar ratio of succinic anhydride groups to polyalkylene groups may range from about 0.5 to about 3.5, such as from about 1 to about 1.3.

A suitable alkylating or quaternizing agent for the second quaternary ammonium salt additive is a hydrocarbyl-substituted carboxylate, such as an alkyl carboxylate or dialkyl carboxylate. In some approaches or embodiments, the quaternizing agent is an alkyl carboxylate selected form alkyl oxalate, dialkyl oxylate, alkyl salicylate, and combinations thereof. In other approaches or embodiments, the alkyl group of the alkyl carboxylate includes 1 to 6 carbon atoms, and is preferably methyl groups. Suitable alkylating or quaternizing agents for the second quaternary ammonium salt additive herein may be dimethyl oxylate or methyl salicylate.

For alkylation with an alkyl carboxylate, it may be desirable in some approaches that the corresponding acid of the carboxylate have a pKa of less than 4.2. For example, the corresponding acid of the carboxylate may have a pKa of less than 3.8, such as less than 3.5, with a pKa of less than 3.1 being particularly desirable. Examples of suitable carboxylates may include, but not limited to, maleate, citrate, fumarate, phthalate, 1,2,4-benzenetricarboxylate, 1,2,4,5-benzenetetracarboxylate, nitrobenzoate, nicotinate, oxalate, aminoacetate, and salicylate. As noted above, preferred carboxylates include oxalate, salicylate, and combinations thereof.

Suitable examples of the quaternary ammonium salt from the above described reactions for the second quaternary ammonium salt additive include, but are not limited to, compounds of the following exemplary structures:

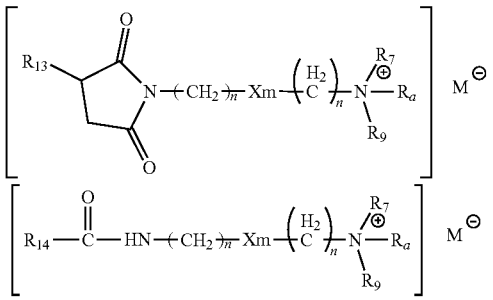

wherein X, $R_7$, $R_8$, $R_9$, $R_{13}$ and M as well as integers n and m are as described above. $R_{10}$ is a C1 to C30 hydrocarbyl group. Due to the length of the hydrocarbyl chain and the presence of the bivalent moiety therein having, in some approaches, an internal oxygen or nitrogen atoms (i.e., the X moiety) discussed above, it is believed the quaternary ammonium salts as described herein include a relatively sterically available quaternary nitrogen that is more available for detergent activity than prior quaternary ammonium compounds.

In approaches, the mixture of the first and second quaternary ammonium salts includes more than 50 weight percent of the second quaternary ammonium salt, and in other embodiments, about 50 to about 99 weight percent, and in yet other approaches, 70 to about 95 weight percent of the first quaternary ammonium salt additive. In yet other approaches, the fuel composition includes about 1 to about 100 ppmw, in other approaches, about 10 to about 75 ppmw, and in yet other approaches, about 30 to about 60 ppmw. Other ranges within the noted endpoints are also within the scope of this disclosure.

Other Quaternary Ammonium Salt Additives

While the above discussion describes the preferred salts for the first and second quaternary ammonium salt additives for the mixtures therein, other quaternary ammonium salt additives may be used for either the first or second quaternary ammonium salt additives salt so long as they contain the called for hydrocarbyl sub stituents and/or unique ratio of the first and the second quaternary ammonium salt additives as described herein. In other aspects, therefore, the first and/or the second quaternary ammonium salt additives may be any quaternary ammonium salt additives having the noted molecular weight substitutions and may be obtained, for instance, by reacting (i) the reaction product of a hydrocarbyl-substituted acylating agent and a compound having at least one oxygen or nitrogen atom capable of condensing with said acylating agent and further having a tertiary amino group and (ii) a quaternizing agent.

In component (i), for example, the hydrocarbyl substituted acylating agent may be a mono- or polycarboxylic acid (or reactive equivalent thereof) for example a substituted succinic, phthalic or propionic acid. The hydrocarbyl substituent in such acylating agents may include at least 8, more preferably at least 12, for example 30 or 50 or more carbon atoms as needed to meet the hydrocarbyl substituent chain length as described above. It may comprise up to about 200 carbon atoms. In other approaches, the hydrocarbyl substituent of the acylating agent may also have a number average molecular weight (Mn) of between about 150 to about 3000, for example from about 150 to about 500 for an acylating agent used to prepare the first quaternary ammonium salt and about 700 to about 3000, or about 800 to about 2500, or from about 900 to about 1500 and more preferably about 900 to about 1100 for an acylating agent used to prepare the second quaternary ammonium salt.

Illustrative of hydrocarbyl substituent based groups containing at least eight carbon atoms are n-octyl, n-decyl, n-dodecyl, tetrapropenyl, n-octadecyl, oleyl, chloroctadecyl, triicontanyl, etc. The hydrocarbyl based substituents may be made from homo- or interpolymers (e.g. copolymers, terpolymers) of mono- and di-olefins having 2 to 10 carbon atoms, for example ethylene, propylene, butane-1, isobutene, butadiene, isoprene, 1-hexene, 1-octene, etc. Preferably these olefins are 1-monoolefins. The hydrocarbyl substituent may also be derived from the halogenated (e.g. chlorinated or brominated) analogs of such homo- or interpolymers. Alternatively the substituent may be made from other sources, for example monomeric high molecular weight alkenes (e.g. 1-tetra-contene) and chlorinated analogs and hydrochlorinated analogs thereof, aliphatic petroleum fractions, for example paraffin waxes and cracked and chlorinated analogs and hydrochlorinated analogs thereof, white oils, synthetic alkenes for example produced by the Ziegler-Natta process (e.g. poly(ethylene) greases) and other sources known to those skilled in the art. Any unsaturation in the substituent may if desired be reduced or eliminated by hydrogenation according to procedures known in the art.

The hydrocarbyl-based substituents are preferably predominantly saturated, that is, they contain no more than one carbon-to-carbon unsaturated bond for every ten carbon to carbon single bonds present. Most preferably they contain no more than one carbon-to-carbon non-aromatic unsaturated bond for every 50 carbon-to-carbon bonds present.

In some preferred embodiments, the hydrocarbyl based substituents are poly-(isobutene)s known in the art. Thus in especially preferred embodiments the hydrocarbyl substituted acylating agent is a polyisobutenyl substituted succinic anhydride.

The preparation of polyisobutenyl substituted succinic anhydrides (PIBSA) is documented in the art. Suitable processes include thermally reacting polyisobutenes with maleic anhydride (see for example U.S. Pat. No. 3,361,673A, 3,018,250), and reacting a halogenated, in particular a chlorinated, polyisobutene (PIB) with maleic anhydride (see for example U.S. Pat. No. 3,172,892). Alternatively, the polyisobutenyl succinic anhydride can be prepared by mixing the polyolefin with maleic anhydride and passing chlorine through the mixture (see for example GB-A-949,981).

Conventional polyisobutenes and so-called "highly reactive" polyisobutenes are suitable for use in the invention. Highly reactive polyisobutenes in this context are defined as polyisobutenes wherein at least 50%, preferably at least 70% or at least 80% or at least 85% or at least 90%, of the terminal olefinic double bonds are of the vinylidene type as described in EP0565285. Particularly preferred polyisobutenes are those having more than 80 mol % and up to 100% of terminal vinylidene groups such as those described in EP1344785.

Other preferred hydrocarbyl groups include those having an internal olefin for example as described in the applicant's published application WO2007/015080. An internal olefin as used herein means any olefin containing predominantly a non-alpha double bond, that is a beta or higher olefin. Preferably such materials are substantially completely beta or higher olefins, for example containing less than 10% by weight alpha olefin, more preferably less than 5% by weight or less than 2% by weight. Typical internal olefins include Neodene 151810 available from Shell. Internal olefins are sometimes known as isomerized olefins and can be prepared from alpha olefins by a process of isomerisation known in the art, or are available from other sources. The fact that they are also known as internal olefins reflects that they do not necessarily have to be prepared by isomerisation.

Examples of the nitrogen or oxygen containing compounds capable of condensing with the acylating agent and further having a tertiary amino group can include but are not limited to: N,N-dimethylaminopropylamine, N,N-diethylaminopropylamine, N,N-dimethylamino ethylamine. The nitrogen or oxygen containing compounds capable of condensing with the acylating agent and further having a tertiary amino group can further include amino alkyl substituted heterocyclic compounds such as 1-(3-aminopropyl)imidazole and 4-(3-aminopropyl)morpholine, 1-(2-aminoethyl) piperidine, 3,3-diamino-N-methyldipropylamine, and 3'3-aminobis(N,N-dimethylpropylamine). Other types of nitrogen or oxygen containing compounds capable of condensing with the acylating agent and having a tertiary amino group include alkanolamines including but not limited to triethanolamine, trimethanolamine, N,N-dimethylaminopropanol, N,N-dimethylaminoethanol, N,N-diethylaminopropanol, N,N-diethylaminoethanol, N,N-diethylaminobutanol, N,N,N-tris(hydroxyethyl)amine, N,N,N-tris(hydroxymethyl)amine, N,N, N-tris(aminoethyl)amine, N,N-dibutylaminopropylamine and N,N, N'-trimethyl-N'-hydroxyethylbisaminoethylether; N,N-bis(3-dimethylaminopropyl)-N-isopropanolamine; N-(3-dimethylaminopropyl)-N,N-diisopropanolamine; N'-(3-(dimethylamino)propyl)-N,N-dimethyl 1,3-propanediamine; 2-(2-dimethylaminoethoxyl) ethanol, N,N,N'-trimethylaminoethylethanolamine, 3-(2-(dimethylamino)ethoxy)propylamine, and N,N-dimethyl dipropylene triamine.

In some preferred embodiments component (i) includes a compound formed by the reaction of a hydrocarbyl substituted acylating agent and an amine of one of the the formulas below:

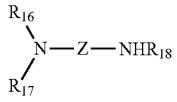

or

-continued

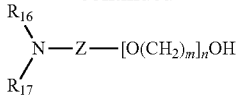

wherein $R_{16}$ and $R_{17}$ of the above formulas are the same or different alkyl groups having from 1 to 22 carbon atoms; Z of the formulas above is an alkylene group having from 1 to 20 carbon atoms that may or may not be interrupted by one or more heteroatoms, such as oxygen or nitrogen; n is from 0 to 20; m is from 1 to 5; and $R_{12}$ of the above formulas is hydrogen or a C2 to C22 alkyl group. When a compound above is used, $R_{18}$ is preferably hydrogen or a C2 to C16 alkyl group, preferably a C2 to C10 alkyl group, more preferably a C2 to C5 alkyl group. More preferably $R_{18}$ is selected from hydrogen, methyl, ethyl, propyl, butyl and isomers thereof. Most preferably $R_{12}$ is hydrogen. Also, m is preferably 2 or 3, most preferably 2; n is preferably from 0 to 15, preferably 0 to 10, more preferably from 0 to 5. Most preferably n is 0 and the compound above may be an alcohol.

Preferably, the hydrocarbyl substituted acylating agent is reacted with a diamine compound above, wherein Z is propylene or propylene-oxo-ethylene. $R_{16}$ and $R_{17}$ may each independently be a C2 to C16 alkyl group, preferably a C2 to C10 alkyl group. $R_{16}$ and $R_{17}$ may independently be methyl, ethyl, propyl, butyl, pentyl, hexyl, heptyl, octyl, or an isomer of any of these. Preferably $R_{16}$ and $R_{17}$ is each independently C2 to C4 alkyl. Preferably $R_{17}$ is methyl. Preferably $R_{17}$ is methyl. In approaches, Z is preferably an alkylene group having 1 to 16 carbon atoms, preferably 1 to 12 carbon atoms, more preferably 1 to 8 carbon atoms, for example 2 to 6 carbon atoms or 2 to 5 carbon atoms. Most preferably Z is an ethylene, propylene or butylene group, especially a propylene group.

The preparation of suitable quaternary ammonium salt additives in which the nitrogen-containing species includes component (i) is described in WO 2006/135881. In preferred embodiments component (i) is the reaction product of a hydrocarbyl-substituted succinic acid derivative (suitably a polyisobutylene-substituted succinic anhydride) and an alcohol or amine also including a tertiary amine group. In some embodiments when the succinic acid derivative is reacted with an amine (also including a tertiary amine group) under conditions to form a succinimide.

To form the quaternary ammonium salt additives useful in the present mixtures, the nitrogen containing species of each of the first and second compounds having a tertiary amine group is reacted with a quaternizing agent. As noted above, the quatenizing agent is suitably selected from the group consisting of dialkyl sulphates; an ester of a carboxylic acid; alkyl halides; benzyl halides; hydrocarbyl substituted carbonates; and hydrocarbyl epoxides in combination with an acid or mixtures thereof. In fuel applications it is often desirable to reduce the levels of halogen-, sulfur-, and phosphorus-containing species. Thus if a quatenizing agent containing such an element is used it may be advantageous to carry out a subsequent reaction to exchange the counterion. For example, a quarternary ammonium salt formed by reaction with an alkyl halide could be subsequently reacted with sodium hydroxide and the sodium halide salt removed by filtration.

The quatemizing agent can include halides, such as chloride, iodide or bromide; hydroxides; sulphonates; bisulphites, alkyl sulphates, such as dimethyl sulphate; sulphones;

phosphates; C1-12 alkylphosphates; di C1-12 alkylphosphates; borates; C1-12 alkylborates; nitrites; nitrates; carbonates; bicarbonates; alkanoates; 0,0-di C1-12 alkyldithiophosphates; or mixtures thereof.

In one embodiment the quatenizing agent may be derived from dialkyl sulphates such as dimethyl sulphate, N-oxides, sulphones such as propane and butane sulphone; alkyl, acyl or aralkyl halides such as methyl and ethyl chloride, bromide or iodide or benzyl chloride, and a hydrocarbyl (or alkyl) substituted carbonates. If the acyl halide is benzyl chloride, the aromatic ring is optionally further substituted with alkyl or alkenyl groups. The hydrocarbyl (or alkyl) groups of the hydrocarbyl substituted carbonates may contain 1 to 50, 1 to 20, 1 to 10 or 1 to 5 carbon atoms per group. In one embodiment the hydrocarbyl substituted carbonates contain two hydrocarbyl groups that may be the same or different. Examples of suitable hydrocarbyl substituted carbonates include dimethyl or diethyl carbonate.

In another embodiment the quaternizing agent can be a hydrocarbonyl epoxide, as represented by the following structure:

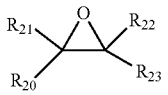

wherein $R_{20}$, $R_{21}$, $R_{22}$ and $R_{23}$ can be independently H or a C1-50 hydrocarbyl group. Examples of hydrocarbyl epoxides can include styrene oxide, ethylene oxide, propylene oxide, butylene oxide, stilbene oxide and C2-50 epoxide. Styrene oxide is especially preferred.

In some embodiments, the quaternizing agent of any embodiment herein may include a compound of the structure below:

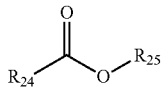

wherein $R_{24}$ is an optionally substituted alkyl, alkenyl, aryl or alkylaryl group; and $R_{25}$ is a C1 to C22 alkyl, aryl or alkylaryl group. The compound above may be an ester of a carboxylic acid capable of reacting with a tertiary amine to form a quaternary ammonium salt. Suitable compounds of the above structure include esters of carboxylic acids having a pKa of 3.5 or less. The compound above may be selected from the diester of oxalic acid, the diester of phthalic acid, the diester of maleic acid, the diester of malonic acid or the diester of citric acid. One especially preferred compound of the structure above is methyl salicylate. In another embodiment, the quaternizing agent is an ester or diester of a polycarboxylic acid. In approaches, the quaternizing agent may be dimethyl oxylate, esters or diesters of maleic acid, and the like.

Quaternary Ammonium Salt Mixtures:

When formulating the fuel compositions of this application, the above described additives (reaction products and/or resultant additives as described above) may be employed in amounts sufficient to reduce or inhibit deposit formation in a fuel system, a combustion chamber of an engine and/or crankcase, and/or within fuel injectors. In some aspects, the fuels may contain minor amounts of the above described reaction product or resulting salt thereof that controls or reduces the formation of engine deposits, for example injector deposits in engines.

For example, any embodiment of the fuels of this disclosure may contain, on an active ingredient basis, an amount of the quaternary ammonium salt mixtures (that is, the combined first and second quaternary ammonium salts) in the range of about 1 ppm to about 100 ppm, in other approaches, about 5 ppm to about 50 ppm, in yet further approaches about 10 ppm to about 25 ppm of the quaternary ammonium salt. It will also be appreciated that any endpoint between the above described ranges are also suitable range amounts as needed for a particular application. The active ingredient basis excludes the weight of (i) unreacted components associated with and remaining in the product as produced and used, and (ii) solvent(s), if any, used in the manufacture of the product either during or after its formation.

In other approaches, the deposit control mixture provides both cationic nitrogen atoms and zitterionic nitrogen atoms (that is quaternary nitrogen in a betaine compound) to the fuel composition as provided by both the preferred first and second quaternary ammonium salt additives described above. For instance, the fuel composition and the additive mixtures herein may include a weight ratio of the first quaternary ammonium salt additive to the second quaternary salt additive of about 1:1 to about 1:10, and in other approaches, a ratio of about 1:1 to about 1:5 In yet other approaches, the fuel compositions and the additive mixtures herein may include a weight ratio of the first quaternary ammonium salt additive (the internal salt or betaine) to the second quaternary ammonium salt additive ranging from at least about 1:3, at least about 1:4, at least about 1:5, at least about 1:6, at least about 1:7, at least about 1:8, at least about 1:9, at least about 1:10, about 1:3 to about 1:10, about 1:4 to about 1:10, or about 1:5 to about 1:10, or about 1:8 to about 1:10. In yet other approaches, the fuel composition includes about 1 to about 10 ppmw of the first quaternary ammonium salt additive and about 30 to about 60 ppmw of the second quaternary ammonium salt additive. Other ranges within the noted endpoints are also within the scope of this disclosure. The deposit control mixtures herein may also include a lower halogen (e.g., chlorine or bromine) content than prior fuel compositions and/or prior quaternary salt ammonium additives.

Other Additives

One or more optional compounds may be present in the fuel compositions of the disclosed embodiments. For example, the fuels may contain conventional quantities of cetane improvers, octane improvers, corrosion inhibitors, cold flow improvers (CFPP additive), pour point depressants, solvents, demulsifiers, lubricity additives, friction modifiers, amine stabilizers, combustion improvers, detergents, dispersants, antioxidants, heat stabilizers, conductivity improvers, metal deactivators, marker dyes, organic nitrate ignition accelerators, cyclomatic manganese tricarbonyl compounds, carrier fluids, and the like. In some aspects, the compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, 2-ethylhexanol, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

Suitable optional cyclomatic manganese tricarbonyl compounds which may be employed in the compositions of the present application include, for example, cyclopentadienyl manganese tricarbonyl, methylcyclopentadienyl manganese tricarbonyl, indenyl manganese tricarbonyl, and ethylcyclopentadienyl manganese tricarbonyl. Yet other examples of suitable cyclomatic manganese tricarbonyl compounds are disclosed in U.S. Pat. Nos. 5,575,823 and 3,015,668 both of which disclosures are herein incorporated by reference in their entirety.

Other commercially available detergents may be used in combination with the reaction products described herein. Such detergents include but are not limited to succinimides, Mannich base detergents, quaternary ammonium detergents, bis-aminotriazole detergents as generally described in U.S. patent application Ser. No. 13/450,638, and a reaction product of a hydrocarbyl substituted dicarboxylic acid, or anhydride and an aminoguanidine, wherein the reaction product has less than one equivalent of amino triazole group per molecule as generally described in U.S. patent application Ser. Nos. 13/240,233 and 13/454,697.

The additives of the present application, including the Mannich-based quaternary ammonium salts described above, and optional additives used in formulating the fuels of this invention may be blended into the base fuel individually or in various sub-combinations. In some embodiments, the additive components of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

Fuels

The fuels of the present application may be applicable to the operation of diesel, jet, or gasoline engines. In one approach, the quaternary ammonium salts herein are well suited for diesel or gasoline as shown in the Examples. The engines may include both stationary engines (e.g., engines used in electrical power generation installations, in pumping stations, etc.) and ambulatory engines (e.g., engines used as prime movers in automobiles, trucks, road-grading equipment, military vehicles, etc.). For example, the fuels may include any and all middle distillate fuels, diesel fuels, biorenewable fuels, biodiesel fuel, fatty acid alkyl ester, gas-to-liquid (GTL) fuels, gasoline, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol. Preferred fuels include diesel fuels.

Accordingly, aspects of the present application are directed to methods of or the use of the quaternary ammonium compounds herein for reducing injector deposits in an internal combustion engine or fuel system for an internal combustion engine, cleaning-up fouled injectors, or unsticking injectors. In another aspect, the quaternary ammonium compounds described herein or fuel containing the quaternary ammonium compounds herein may be combined with one or more of polyhydrocarbyl-succinimides, -acids, -amides, -esters, -amide/acids and -acid/esters, reaction products of polyhydrocarbyl succinic anhydride and aminoguanidine and its salts, Mannich compounds, and mixtures thereof. In other aspects, the methods or use include injecting a hydrocarbon-based fuel comprising a quaternary ammonium compounds of the present disclosure through the injectors of the engine into the combustion chamber, and igniting the fuel to prevent or remove deposits on fuel injectors, to clean-up fouled injectors, and/or to unstick injectors. In some aspects, the method may also comprise mixing into the fuel at least one of the optional additional ingredients described above.

EXAMPLES

The following examples are illustrative of exemplary embodiments of the disclosure. In these examples as well as elsewhere in this application, all ratios, parts, and percentages are by weight unless otherwise indicated. It is intended that these examples are being presented for the purpose of illustration only and are not intended to limit the scope of the invention disclosed herein.

Example 1

An oleylamidopropyl dimethylammonium betaine quaternary ammonium internal salt can be made by the process described in U.S. Pat. No. 8,894,726 (Inventive Example 3), which is incorporated herein by reference.

Example 2

A quaternary ammonium salt was prepared as follows: 207.95 grams (0.218 equivalents of anhydride) of polyisobutenyl succinic anhydride (PIBSA, made with about 1000 molecular weight polyisobutylene, PIB, and maleic anhydride) and 92.60 grams of toluene were charged in a 1 liter reaction flask equipped with Dean-Stark trap. Under nitrogen, the mixture was stirred and heated to 90° C. Over about 10 minutes, 22.30 grams of N,N-dimethylamino propylamine (DMAPA) was added. The temperature was increased to about 165° C. and held for 4 hours while removing water. Toluene was removed under vacuum. IR spectroscopy of the product confirmed formation of the succinimide. Next, 100.53 grams (0.0970 moles) of the formed succinimide product and 14.76 grams (0.0970 moles) of methyl salicylate were charged in a 250 ml reaction flask. The mixture was heated under nitrogen to 140° C. and held for 7 hours. $^1$H NMR spectroscopy of the product confirmed formation of a quaternary ammonium salt.

Example 3

A quaternary ammonium salt was prepared as follows: 249.05 grams (0.882 moles) of oleic acid and 60.35 grams of toluene where charged in a 1 liter reaction flask equipped with Dean-Stark trap. Under nitrogen, the mixture was stirred and heated to 100° C. Over about 20 minutes, 128.77 grams (0.882 moles) of 3-(2-(dimethylamino)ethoxy) propylamine (DMAEPA) was added. The temperature was increased to about 165° C. and held for 4 hours while removing water. Toluene was removed under vacuum. IR spectroscopy of the product confirmed formation of the amide. Next, 7.50 grams (0.0183 moles) of the amide and 2.80 grams (0.0184 moles) of methyl salicylate were charged in a thick walled glass tube and sealed. The mixture was heated under nitrogen to 140° C. and held for 12 hours. $^1$H NMR spectroscopy of the product confirmed formation of the quaternary ammonium salt.

Example 4

A quaternary ammonium salt was prepared as follows: 270.93 grams (0.679 equivalents of anhydride) of a $C_{20-24}$ alkenyl succinic anhydride (ASA) and 105.73 grams of toluene were charged in a 1 liter reaction flask equipped with Dean-Stark trap. Under nitrogen, the mixture was stirred and heated to 100° C. Over about 15 minutes, 99.13 grams (0.679 moles) of 3-(2-(dimethylamino)ethoxy) propylamine (DMAEPA) was added. The temperature was increased to about 160° C. and held for 4 hours while removing water. Toluene was removed under vacuum. IR spectroscopy of the product confirmed formation of the amide. Next, 106.71 grams (0.202 moles) of the amide and 30.78 grams (0.202 moles) of methyl salicylate were charged in a 250 ml reaction flask. The mixture was heated under nitrogen to 140° C. and held for 6 hours. $^1$H NMR spectroscopy of the product confirmed formation of the quaternary ammonium salt.

Example 5

A quaternary ammonium salt was prepared as follows: 207.75 grams (0.218 equivalents of anhydride) of PIBSA (made with about 1000 molecular weight PIB and maleic anhydride) and 67.96 grams of toluene were charged in a 1 liter reaction flask equipped with Dean-Stark trap. Under nitrogen, the mixture was stirred and heated to 100° C. Over about 15 minutes, 30.24 grams (0.207 moles) of 3-(2-(dimethylamino)ethoxy) propylamine (DMAEPA) was added. The temperature was increased to about 160° C. and held for 3 hours while removing water. Toluene was removed under vacuum. IR spectroscopy of the product confirmed formation of the succinimide. Next, 67.20 grams (0.057 moles) of the succinimide and 8.69 grams (0.057 moles) of methyl salicylate were charged in a 250 ml reaction flask. The mixture was heated under nitrogen to 140° C. and held for 6 hours. $^1$H NMR spectroscopy of the product confirmed formation of the quaternary ammonium salt.

Example 6

A quaternary ammonium salt was prepared as follows: 287.50 grams (0.126 equivalents of anhydride) of PIBSA (made with 2300 molecular weight PIB and maleic anhydride) and 96.15 grams of toluene were charged in a 1 liter reaction flask equipped with Dean-Stark trap. Under nitrogen, the mixture was stirred and heated to 100° C. Over about 5 minutes, 18.20 grams (0.125 moles) of 3-(2-(dimethylamino)ethoxy)propylamine (DMAEPA) was added. The temperature was increased to about 160° C. and held for 4 hours while removing water. Toluene was removed under vacuum. IR spectroscopy of the product confirmed formation of the succinimide. Next, 95.37 grams (0.0396 moles) of the succinimide and 6.02 grams (0.0396 moles) of methyl salicylate were charged in a 250 ml reaction flask. The mixture was heated under nitrogen to 140° C. and held for 6 hours. 41 NMR spectroscopy of the product confirmed formation of the quaternary ammonium salt.

Example 7

A quaternary ammonium salt was prepared as follows: 283.62 grams (0.298 equivalents of anhydride) of PIBSA (made with about 950 molecular weight PIB and maleic anhydride) and 82.31 grams of toluene were charged in a 1 liter reaction flask equipped with Dean-Stark trap. Under nitrogen, the mixture was stirred and heated to 100° C. Over about 15 minutes, 47.37 grams (0.298 moles) of N,N dimethyldipropylene triamine (DMAPAPA) was added. The temperature was increased to about 160° C. and held for 2 hours while removing water. Toluene was removed under vacuum. IR spectroscopy of the product confirmed formation of the succinimide. Next, 78.31 grams (0.0717 moles) of the succinimide and 10.90 grams (0.0717 moles) of methyl salicylate were charged into a 250 ml reaction flask. The mixture was heated under nitrogen to 160° C. and held for 6 hours. $^1$H NMR spectroscopy of the product confirmed formation of the quaternary ammonium salt.

Example 8

In a 4 liter glass reaction vessel, 1999.98 grams (2.10 moles) of Dovermulse H 1000 polyisobutylene succinic anhydride (PIBSA made using 1000 Mn polyisobutylene available from Dover Chemical) and 1 drop of silicone fluid (as an antifoam agent) were mixed and heated to 167° C. under a blanket of nitrogen. Once the mixture had reached 167° C., 307.21 grams (2.10 moles) of 3-(2-(dimethylamino) ethoxy) propylamine (DMAEPA) was added over the course of 11 minutes. Once the DMAEPA was added, a vacuum (26" Hg) was applied to the mixture to remove the water generated during the formation of the imide. The mixture was stirred and held under vacuum at 167° C. for 2 hours. An IR spectrum of the product confirmed the formation of polyisobutylene succinimide (PIBSI), a brown viscous liquid. Next, 1600.02 grams (1.48 moles) of the formed PIBSI and 198.00 grams of Solvesso 150 ND aromatic solvent (available from ExxonMobil Chemical) were mixed and heated to 125° C. under a blanket of nitrogen. 183.62 grams (1.55 moles) of dimethyl oxalate was added and the mixture was maintained at 125° C. for 3 hours with constant stirring. A $^{13}$C NMR spectrum of the brown viscous liquid product confirmed the formation of the quaternary ammonium salt. For ease of handling, an additional 566.45 grams of Solvesso 150 ND was added to bring the mixture to 70/30 weight % product/solvent.

Example 9

A DW-10 test was performed to determine individual additives as well as the inventive deposit control mixtures ability to clean up fouled injectors in a diesel engine using a test outlined in CEC F-98-08.

Using the test cycle and dopant (1 ppm Zn as zinc neodecanoate) used in CEC F-98-08, inventive additives were evaluated for their ability in diesel fuel to remove (clean up) deposits. To perform this evaluation, the engine was first run with zinc dopant in the fuel, resulting in a power loss due to fouling of the injector holes. Then, the engine was run on fuel containing both the zinc dopant and detergent additive(s). A more detailed description of this protocol can be found in U.S. Pat. No. 8,894,726 B2 (Column 9) or U.S. Pat. No. 9,464,252 B2 (columns 10 and 11), which are incorporated herein by reference and further discussed below.

Diesel Engine Test Protocol: The DW-10 test was developed by Coordinating European Council (CEC) to demonstrate the propensity of fuels to provoke fuel injector fouling and can also be used to demonstrate the ability of certain fuel additives to prevent or control these deposits. Additive evaluations used the protocol of CEC F-98-08 for direct injection, common rail diesel engine nozzle coking tests. An engine dynamometer test stand was used for the installation of the Peugeot DW10 diesel engine for running the injector coking tests. The engine was a 2.0 liter engine having four cylinders. Each combustion chamber had four valves and the fuel injectors were DI piezo injectors have a Euro V classification.

The core protocol procedure consisted of running the engine through a cycle for 8-hours and allowing the engine to soak (engine off) for a prescribed amount of time. The foregoing sequence was repeated four times. At the end of each hour, a power measurement was taken of the engine while the engine was operating at rated conditions. The injector fouling propensity of the fuel was characterized by a difference in observed rated power between the beginning and the end of the test cycle.

Test preparation involved flushing the previous test's fuel from the engine prior to removing the injectors. The test injectors were inspected, cleaned, and reinstalled in the engine. If new injectors were selected, the new injectors were put through a 16-hour break-in cycle. Next, the engine was started using the desired test cycle program. Once the engine was warmed up, power was measured at 4,000 RPM and full load to check for full power restoration after cleaning the injectors. If the power measurements were within specification, the test cycle was initiated. Table 1 below provides a representation of the DW-10 coking cycle that was used to evaluate the fuel additives according to the disclosure.

TABLE 1

One hour representation of DW-10 coking cycle

| Step | Duration (minutes) | Engine speed (rpm) | Load (%) | Torque (Nm) | Boost air after Intercooler (° C.) |
|---|---|---|---|---|---|
| 1 | 2 | 1750 | 20 | 62 | 45 |
| 2 | 7 | 3000 | 60 | 173 | 50 |

TABLE 1-continued

One hour representation of DW-10 coking cycle

| Step | Duration (minutes) | Engine speed (rpm) | Load (%) | Torque (Nm) | Boost air after Intercooler (° C.) |
|---|---|---|---|---|---|
| 3 | 2 | 1750 | 20 | 62 | 45 |
| 4 | 7 | 3500 | 80 | 212 | 50 |
| 5 | 2 | 1750 | 20 | 62 | 45 |
| 6 | 10 | 4000 | 100 | * | 50 |
| 7 | 2 | 1250 | 10 | 25 | 43 |
| 8 | 7 | 3000 | 100 | * | 50 |
| 9 | 2 | 1250 | 10 | 25 | 43 |
| 10 | 10 | 2000 | 100 | * | 50 |
| 11 | 2 | 1250 | 10 | 25 | 43 |
| 12 | 7 | 4000 | 100 | * | 50 |

Individual additives as well as mixtures of the quaternary ammonium salt additives of Example 1 (e.g., an exemplary First Quaternary Salt Additive) and Example 8 (e.g., an exemplary Second Quaternary Salt Additive) were tested using the foregoing engine test procedure in an ultra-low sulfur diesel fuel containing zinc neodecanoate, 2-ethylhexyl nitrate, and a fatty acid ester friction modifier (base fuel). A "dirty-up" phase consisting of base fuel only with no additive was initiated, followed by a "clean-up" phase consisting of base fuel plus additive as noted in Table 2 below. All runs were made with 8 hour dirty-up and 8 hour clean-up unless indicated otherwise. The percent power recovery was calculated using the power measurement at end of the "dirty-up" phase and the power measurement at end of the "clean-up" phase. The percent power recovery was determined by the following formula: Percent Power recovery=(DU-CU)/DU×100, wherein DU is a percent power loss at the end of a dirty-up phase without the additive, CU is the percent power at the end of a clean-up phase with the fuel additive, and power is measured according to CEC F98-08 DW10 test.

First the individual quaternary ammonium salt additives of Example 1 and Example 8 were tested in Table 2 below.

TABLE 2 comparative additives

| Example 8 Treat Rate (ppmw) | Example 1 Treat Rate (ppmw) | Power Loss After Dirty-Up (%) | Power Loss After 8 hr Clean Up (%) | Observed CU (%) |
|---|---|---|---|---|
| 0 | 0 | 5.00 | 7.80 | −56.0 |
| 40 | 0 | 4.88 | 2.46 | 49.6 |
| 55 | 0 | 4.86 | 0.83 | 82.9 |
| 65 | 0 | 5.61 | −0.39 | 107.0 |
| 0 | 0 | 5.00 | 7.80 | −56.0 |
| 0 | 17.4 | 4.49 | 3.31 | 26.3 |
| 0 | 34.8 | 5.19 | −0.89 | 117.1 |

Figure 2:
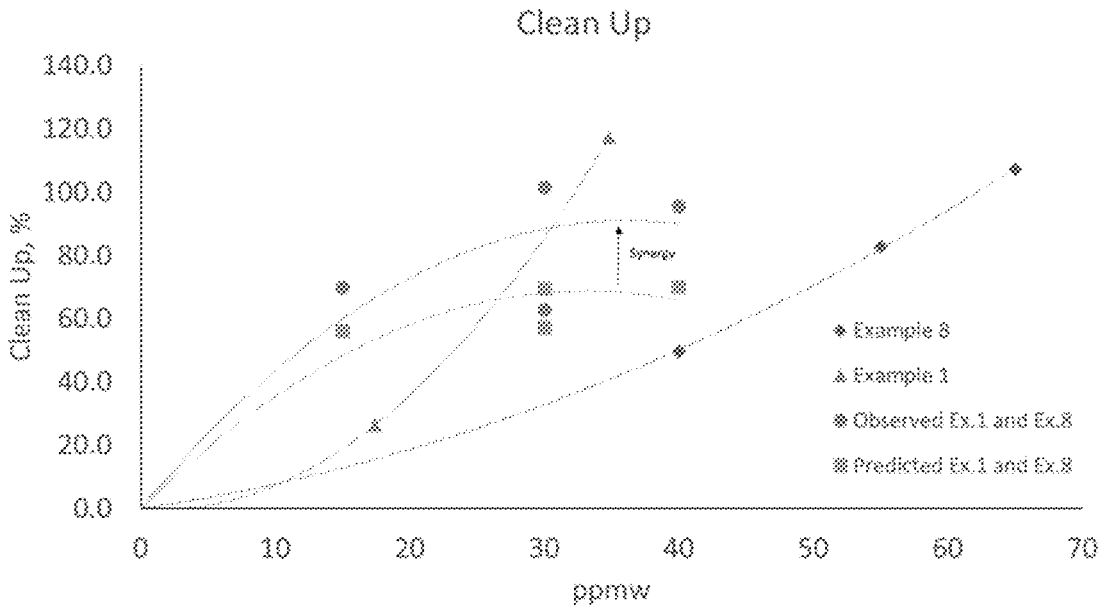
FIG. 2 is a plot of clean-up percentage relative to additive treat rate showing synergy.

Next, mixtures of the quaternary ammonium salt of Example 8 and the quaternary ammonium salt of Example 1 were tested and the clean-up observed was compared to the expected clean-up predicted from the use of each additive alone. As shown in Table 3 below, there was an unexpected synergy between the two additives because the observed clean-up was better than what was predicted from the combination. FIGS. 1 to 2 also show the unexpected synergy of the mixtures as compared to the individual additives.

TABLE 3

| Inventive Mixtures | | | | | | |
|---|---|---|---|---|---|---|
| Example 8 Treat Rate (ppmw) | Example 1 Treat Rate (ppmw) | Predicted CU (%) | Power Loss After Dirty-Up (%) | Power Loss After 8 hr Clean Up (%) | Observed CU (%) | Synergy Ratio (Observed/ Predicted) |
| 15 | 15 | 56.1 | 5.28 | 1.59 | 69.9 | 1.25 |
| 30 | 7.5 | 57.2 | 5.51 | 2.05 | 62.8 | 1.10 |
| 30 | 10 | 69.5 | 5.07 | −0.08 | 101.6 | 1.46 |
| 40 | 5 | 70.3 | 5.21 | 0.23 | 95.6 | 1.36 |

FIG. 1 is a plot of power recovery after 8 hours of clean-up of the additives individually from Table 2. Using the slope of the curves and the clean-up level of unadditized fuel as the intercept, the predicted clean-up of combinations can be determined as shown in Table 3 with the predicted clean-up and the synergy ratio of the observed and predicted performance. FIG. 2 compares the clean-up as predicted and the clean-up as observed showing the unexpected improvement of clean-up using the two additives together. The synergy ratio of Table 3 above shows an improved clean-up from what would have been predicted from using each additive individually.

The data in Table 2 was used to quantify the individual effects of the Example 1 and Example 8 additives on % clean-up (CU) in the DW-10 test. The observed % CU was plotted against treat rate and found to be linear for each additive. The slope of the best fit line in each plot is the response factor of the additive. For Example 1, the response factor was 4.93% CU per ppmw of additive. For Example 8, the response factor was 2.54% CU per ppmw of additive. These response factors, along with the % CU with no additive present (-56%), can be used to calculate a predicted % CU if no synergy existed between the 2 additives:

Predicted % CU=−56%+(4.93% CU/ppmw*ppmw Ex. 1)+(2.54% CU/ppmw*ppmw Ex. 8)

Thus, for the first Inventive Mixture in Table 3:

Predicted % CU=−56%+(4.93% CU/ppmw*15 ppmw)+(2.54% CU/ppmw*15 ppmw)=56.1%

Thus, the observed % CU (69.9%) for the Inventive Mixture of 15 ppmw Example 1 and 15 ppmw Example 8 is unexpectedly better than the predicted % CU (56.1%).

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A method of providing improved engine performance, the method comprising:

providing a fuel composition to an engine and combusting the fuel composition in the engine;

the fuel composition including a major amount of fuel and a minor amount of a deposit control mixture, the deposit control mixture including 5 to 15 ppm of a first quaternary ammonium salt additive and about 15 to 40 ppm of a second quaternary ammonium salt additive, the deposit control mixture including no more than 50 weight percent of the first quaternary ammonium salt additive;

wherein the first quaternary ammonium salt additive has the structure of Formula II $R_4—C(O)—N(R_6)—R—\hat{N}^+(R_5)(R_5)—R'—C(O)\hat{O}^-$ (Formula II)

wherein $R_4$ is a C8 to C20 hydrocarbyl group, each of R and R' are independently alkylene linkers having 1 to 3 carbon atoms, each $R_5$ is a methyl group, and $R_6$ is hydrogen;

the second quaternary ammonium salt additive has the structure of Formula III $[(R_{10})(R_{11})N—(CH_2)_n—X_m—(CH_2)_n—X_m—(CH_2)_n—N^+(R_7)(R_8)(R_9)]^-$ (Formula III)

wherein each X is an oxygen atom; each $R_7$, $R_8$, and $R_9$ are independently alkyl groups containing 1 to 8 carbon atoms; wherein $R_{10}$ and $R_{11}$ of Formula III, together with the nitrogen atom to which they are attached, combine to form a hydrocarbyl substituted succinimide with the hydrocarbyl substituent having a number average molecular weight of about 700 to about 1,500 as measured by GPC using polystyrene as a calibration reference; each m is independently an integer of 0 or 1 with at least one m being 1; each n is independently an integer of 1 to 10; and MΘ is a oxalate, salicylate, or combinations thereof;

wherein the deposit control mixture includes a ratio of the first quaternary ammonium salt additive to the second quaternary ammonium salt additive of 1:1 to 1:8; and wherein the fuel composition includes no more than about 100 ppmw of the deposit control mixture including both the first and second quaternary ammonium salt additives.

2. The method of providing improved engine performance of claim 1, wherein the deposit control mixture includes a ratio of the first quaternary ammonium salt additive to the second quaternary ammonium salt additive of 1:5 to 1:8.

3. The method of providing improved engine performance of claim 1, wherein R' of Formula II is a methylene linker.

4. The method of providing improved engine performance of claim 1, wherein the second quaternary ammonium salt additive of Formula III is derived from 3-(2-(dimethylamino)ethoxy)propylamine, N,N-dimethyldipropylenetriamine, or mixtures thereof.

5. A fuel composition including a deposit control additive mixture for providing improved engine performance, the fuel composition comprising:

a major amount of fuel and a minor amount of a deposit control additive mixture including at least 5 to 15 ppm of a first quaternary ammonium salt additive and 15 to 40 ppm of a second quaternary ammonium salt additive, wherein the deposit control additive mixture includes no more than 50 weight percent of the first quaternary ammonium salt additive;

wherein the first quaternary ammonium salt additive has the structure of Formula II $R_4—C(O)—N(R_6)—R—\hat{N}^+(R_5)(R_5)—R'—C(O)\hat{O}^-$ (Formula II)

wherein $R_4$ is a C8 to C20 hydrocarbyl group, each of R and R' are independently alkylene linkers having 1 to 3 carbon atoms, each $R_5$ is a methyl group, and $R_6$ is hydrogen;

the second quaternary ammonium salt additive has the structure of Formula III $[(R_{10})(R_{11})N—(CH_2)_n—X_m—(CH_2)_n—X_m—(CH_2)_n—N^+(R_7)(R_8)(R_9)]^-$ (Formula III)

wherein each X is an oxygen atom; each $R_7$, $R_8$, and $R_9$ are independently alkyl groups containing 1 to 8 carbon atoms; wherein $R_{10}$ and $R_{11}$ of Formula III, together with the nitrogen atom to which they are attached, combine to form a hydrocarbyl substituted succinimide with the hydrocarbyl substituent having a number average molecular weight of about 700 to about 1,500 as measured by GPC using polystyrene as a calibration reference; each m is independently an integer of 0 or 1 with at least one m being 1; each n is independently an integer of 1 to 10; and MΘ is a carboxylate oxalate, salicylate, or combinations thereof;

wherein the deposit control additive mixture provides a weight ratio of the first quaternary ammonium salt additive to the second quaternary ammonium salt additive of 1:1 to 1:8; and wherein the fuel composition includes no more than about 100 ppmw of the deposit control additive mixture including both the first and second quaternary ammonium salt additives.

6. The fuel composition of claim 5, wherein the deposit control additive mixture provides a weight ratio of the first quaternary ammonium salt additive to the second quaternary ammonium salt additive of about 1:5 to 1:8.

7. The fuel composition of claim 5, wherein the deposit control additive mixture includes about 10 to about 40 weight percent of the first quaternary ammonium salt additive.

* * * * *